United States Patent [19]

Hauschopp et al.

[11] 4,108,495

[45] Aug. 22, 1978

[54] GUIDES FOR MINERAL MINING MACHINES

[75] Inventors: Alois Hauschopp, Werne; Wolfgang Peters, Selm, both of Fed. Rep. of Germany

[73] Assignee: Gewerkschaft Eisenhütte Westfalia, Lunen, Fed. Rep. of Germany

[21] Appl. No.: 771,266

[22] Filed: Feb. 23, 1977

[30] Foreign Application Priority Data

Feb. 24, 1976 [DE] Fed. Rep. of Germany ..... 2607350

[51] Int. Cl.[2] ..... E21C 35/20

[52] U.S. Cl. ..... 299/43

[58] Field of Search ..... 299/32, 34, 43, 45

[56] References Cited

U.S. PATENT DOCUMENTS

| | | | |
|---|---|---|---|
| 3,456,983 | 7/1969 | Rassmann | 299/34 |
| 3,633,972 | 1/1972 | Spies | 299/34 |

FOREIGN PATENT DOCUMENTS

| | | | |
|---|---|---|---|
| 1,277,181 | 9/1968 | Fed. Rep. of Germany | 299/34 |

*Primary Examiner*—Ernest R. Purser

*Attorney, Agent, or Firm*—Thompson, Birch, Gauthier & Samuels

[57] ABSTRACT

A guide for a mineral winning or loading machine, such as a coal plough, is composed of assemblies secured to the mineral face side of a conveyor. The assemblies have angle plates with upstanding wall portions securable to the side walls of the conveyor and integral foot portions supporting the machine and resting on the floor of the mine working. Spacers separating upper and lower passages for guiding a drive chain are in turn secured to the wall portions of the angle plates and these passages are shielded by cover plates formed with ramp-like inclined guide surfaces for the machine. The cover plates are pivoted to the spacers at their lower regions so that they can be pivoted outwards to allow access to the passages therebehind. The cover plates are locked with releasable devices to the wall portions in their closed position and have recesses accommodating the spacers which have inclined surfaces forming continuations of the guide surfaces of the cover plates.

18 Claims, 10 Drawing Figures

GUIDES FOR MINERAL MINING MACHINES

BACKGROUND TO THE INVENTION

The present invention relates to guides for mineral winning and/or loading machines and particularly, but not solely, to guides for coal ploughs. A known guide is formed from components attached to the mineral face side of a conveyor with the machine moving back and forth along the guide. The machine is driven by a chain running in guide passages at the side of the conveyor and cover plates screen off these passages and perform a guiding function vis a viz the machine. The cover plates are usually pivoted to enable them to be swung outwards to permit access to the guide passages. A known guide of this type is described in German Pat. Spec. No. 1277181. Here the cover plates have welded attachments forming a guide rail at their lower ends for engaging an arm of the machine extending into the lower chain guide passage for connection to the drive chain. Attachments also provide apertures at the ends of the cover plates for receiving hinge pins for effecting the pivotal mounting of the cover plates. Spacers inside the cover plates separate the upper and lower chain guide passages.

It is also known from German Pat. Spec. No. 2253567 to provide the pivot joints for the cover plates at the upper regions but this is generally undesirable since adequate space must be provided above the guide to allow the upward swivelling of the cover plates.

A general object of the present invention is to provide an improved guide and guide assembly of the aforementioned kind.

SUMMARY OF THE INVENTION

The present invention relates to a guide for a mining machine of the type which has means defining upper and lower chain guide passages along which a drive chain for the machine is circulated, cover plates covering the guide passages and means pivotably mounting the cover plates to permit them to be swung outwards for access to the guide passages. In accordance with the invention, the defining means includes a plurality of separate spacers separating the guide passages in a vertical sense, the pivot mounting means takes the form of hinge connections pivoting the cover plates to the spacers and the cover plates are recessed to accept the spacers with the spacers and cover plates combining to form a continuous ramp-like guide surface.

The guide of the invention is preferably composed of guide assembly units each comprising an angle plate with an upstanding first portion for securing to a conveyor side wall and a second foot portion inclined thereto to form a support for the machine, a ramp-like cover plate mounted in relation to said first portion to combine therewith and define at least part of upper and lower chain guide channels, spacing elements spaced-apart longitudinally of the assembly and separating the upper and lower chain guide channels 1, pivot connections established between the spacing elements and the cover plate to permit the latter to adopt an upright position closing off the chain guide channels and a swung-out position permitting access to the chain guide channels and recesses in the cover plates shaped to receive the spacing elements therein.

The pivot joints for the cover plates are preferably provided by depending hollow portions of the spacing elements receiving hinge pins locating in apertures in the cover plates. The spacing elements themselves are preferably one-piece integral structures each with a web portion separating the chain guide passages and adjoining the depending hollow portion. The spacing elements preferably have inclined surfaces which correspond to ramp-like surfaces of the cover plates and which lie co-planar therewith to form continuations thereof when the cover plates are in their upper closed position. The elements and the associated recesses in the cover plates may have a rectangular profile as viewed from the mineral face. The spacing elements can be tightly enclosed by the recesses with the cover plates in their upright closed position thereby assisting in locating and retaining the cover plates. Preferably however additional locking means is provided for locking the cover plates in their closed position.

Various forms of locking means can be adopted as described hereinafter.

It is desirable to form the hinge pin apertures of the cover plates from curved-over lower regions of the cover plates since this will provide an additional guide surface for the machine. In known manner the machine may have an arm connected with the lower chain run and extending through a slot between the cover plates and the foot portions of the angle plates. This arm may engage on the additional guide surface. The pivot joints are formed in the vicinity of this guide surface and ensure that the guide adopts a comparatively low overall height thus making the construction especially suitable for use with thin seams.

The guide assemblies can be secured to the conveyor side wall or to spill plates thereon by means of screws or bolts locating through holes in the web portions of the spacing elements and having heads received in enlarged recesses in the inclined surfaces thereof.

The present invention also provides a guide for a mineral mining machine; said guide comprising cover plates covering upper and lower chain-drive guide passages formed alongside a mineral face; spacing elements separating the chain guide passages; pivot joints between the spacing elements and the cover plates for enabling the cover plates to be pivoted outwards to permit access to the guide passages and recesses in the cover plates into which the spacing elements are positioned when the cover plates are in their normal position covering the guide passages.

A guide made in accordance with the invention is comparatively simple to construct yet produces an especially sturdy rigid structure.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
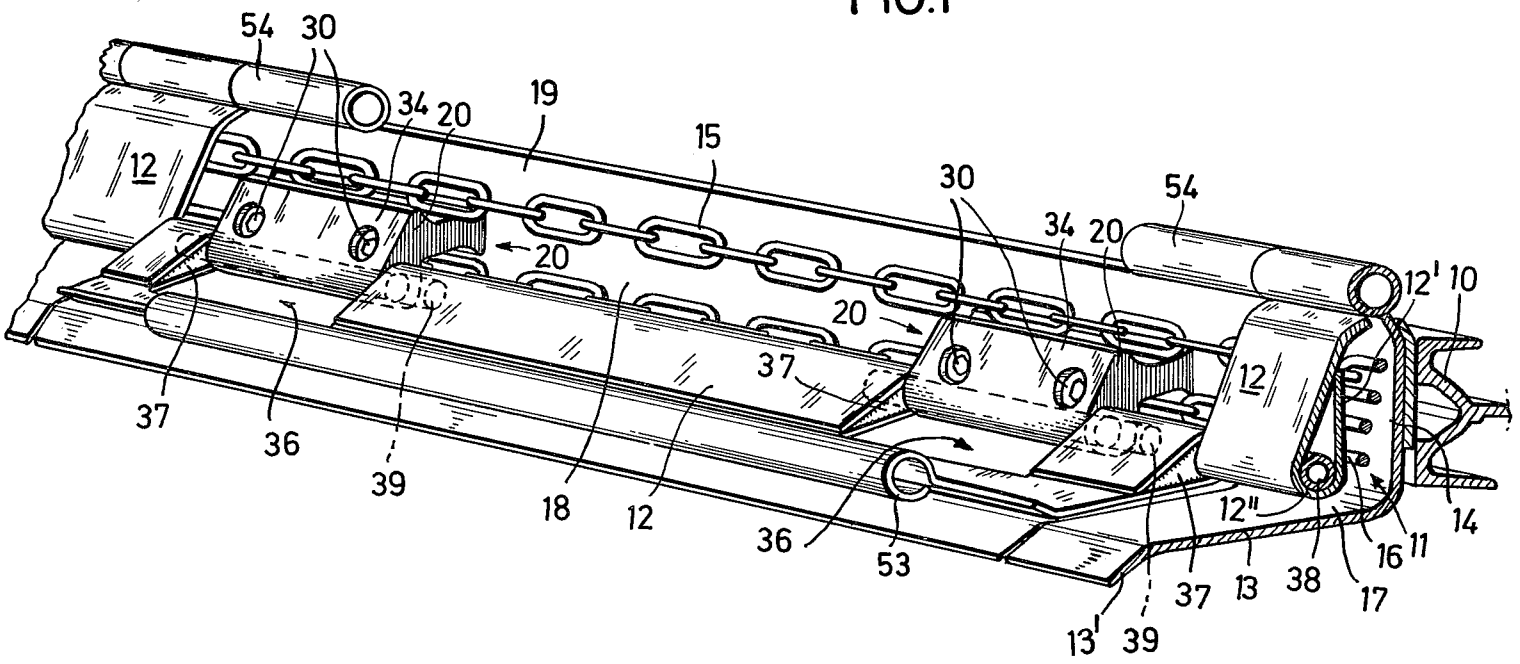
FIG. 1 is a perspective view of a guide and guide assembly made in accordance with the invention.

In general, a guide intended for guiding a mineral winning machine, and more particularly a coal plough, is formed from guide assemblies or units arranged end-to-end and attached to the mineral, e.g., coal, face side of a scraper-chain conveyor. The conveyor is not shown in detail but is composed in known manner of a series of channel sections or pans arranged end-to-end and interconnected to allow some restricted movement therebetween. FIG. 1 shows one side wall 10 of one of the conveyor pans. Each guide assembly is allocated to one of the conveyor pans and has a length corresponding to that of the associated pan. In this way the guide assemblies combine to form a more or less continuous guide along which the machine or plough can be moved to strip mineral from the mineral, e.g., coal face. The individual guide assemblies are preferably interconnected to permit restricted pivotal or angular mobility therebetween while resisting traction forces, i.e., along the guide. The guide is particularly designed for accepting a coal plough without a base or sword plate extending beneath the conveyor.

Referring now to FIGS. 1 to 5, each guide assembly has an angle plate 11 with an upstanding portion 14 secured to the side wall of the associated conveyor channel section or pan and a lower foot portion 13 which adopts a horizontal or near-horizontal disposition. The portion 13 forms a lower support or slideway for the body of the plough. The foot portion 13 of the plate 11 terminates at a down-turned lip 13' the free edge of which is intended to engage on the floor of the mine working at or near the juncture between the mineral face seam and the floor of the mine working. In this way the plate 11 is supported in a rigid manner. The portion 14 of the plate 11 is secured to the conveyor pan side wall 10 with screws 30 or the like and here an intermediate attachment in the form of a spill plate is interposed between the portion 14 and the side wall 10. Ramp-like cover plates 12 serve to additionally guide the plough body. One such cover plate 12 is provided for each assembly and as shown in FIG. 1, the plate 12 can be pivoted outwardly from the portion 14 of the plate 11.

In known manner the plough is driven along the guide by means of a chain with upper and lower runs 15, 16 protected by the cover plates 12 and located in upper and lower guide passages or channels 19, 18 respectively. The machine or plough would be connected to the lower traction run 16 of the chain and for this purpose the body of the plough has one or more guide arms (not shown) which project through a slot 17 formed between the lower foot portions 13 of the plates 11 and the cover plates 12.

Figure 2:
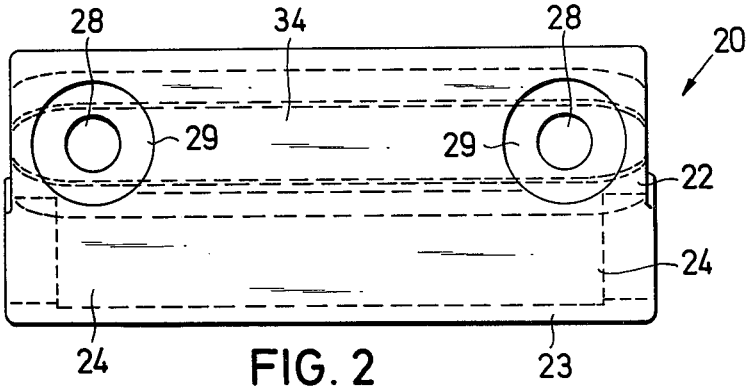
FIG. 2 is an elevation of a spacer element of the assembly shown in FIG. 1.
Figure 3:
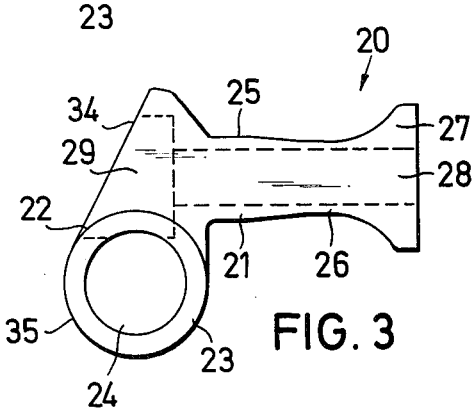
FIG. 3 is an end view of the spacer element shown in FIG. 2.

The or each arm preferably has a guide block connected to the chain run 16 and guided in the guide channel 18. The chain guide channels 18, 19 are separated by spacer elements 20 which engage on the upper portions 14 of the plates 11. Each assembly employs two spacer elements 20 which are spaced apart longitudinally of the assembly and arranged near the ends thereof as shown in FIG. 1. FIGS. 2 and 3 depict one of the spacer elements 20. As shown in FIGS. 2 and 3, the spacer element 20 is one-piece integral structure preferably fabricated by forging. The element 20 has a main body or web 21 which separates and defines the chain guide channels 18, 19, and a hollow head piece 22 with a downwardly projecting region providing a cylindrical lower part 23 with a curved exterior 35 and a circular bore 24 for accommodating a hinge pin. The web 31 is shaped to provide a trough 25 at its upper side and a trough 26 at its lower side to thereby define the chain guide channels 18, 19. The inner end region of the web 21 is enlarged as at 27 to form a support for engaging in the upper portion 14 of the plate 11.

Figure 4:
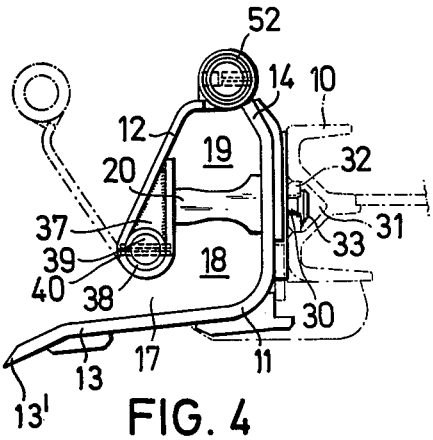
FIG. 4 is an end view of the assembly of FIG. 1.

As shown in FIG. 3, the head piece 22 has an inclined outer face 34 designed to match the cover plate 12. As shown in FIG. 2, the spacer element 20 has a rectangular profile and two bores 28 are located near the ends thereof and extend through the web 21. Each bore 28 adjoins an enlarged recess 29 coaxial therewith and extending into the head piece 22. The bores 28 serve to receive fixing bolts or screws 30 (FIG. 1) having heads received in the recesses 29. The bolts or screws 30 serve to secure the associated spacing element 20 and the plate 11 of the assembly to the spill plate attachment. These spill plates are in turn secured to the conveyor pan side wall with the aid of mounting devices 32 (FIG. 4) welded into the V-shaped grooves 31 in the pan side walls. As shown in FIG. 4, the devices 32 support and locate screws 33 permitting the attachment of the spill plates in side-by-side relationship with the pan side walls.

Figure 5:
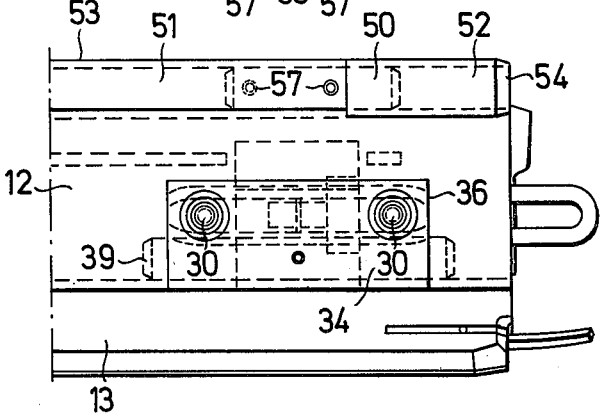
FIG. 5 is an elevation of an end region of the assembly showing particularly the locking devices employed.

Referring now to FIGS. 1, 4 and 5, each cover plate 12 has recesses 36 having a similar rectangular profile to the spacing elements so as to receive the spacing elements 20.

As shown particularly in FIG. 1, where adjacent cover plates 12 are represented in their normal closed position and in their pivoted open position, each plate 12 is shaped with the curved-over lower region 12" providing an aperture. A rear continuation of the region 12" provides a flange 12' extending parallel to the portion 14 of the plate 11 when the cover plate 12 is in the normal closed position. The upper edge of the flange 12' is welded to the inner face of the cover plate 12. Web plates 37 are welded between the flange 12' and the inner face of the cover plate 12 and these plates 37 have bores 38 which locate at the bottom of the aperture provided by the curved region 12". A pivotal connection is established between each cover plate 12 and the adjacent spacer elements 20 with the aid of hinge pins 39 which locate in the bores 38 of the cover plate 12 and in the bores 24 of the spacer elements 20. The pins 39 are secured with the aid of clamping rods 40 (FIG. 4) or the like which locate in the spacer elements 20 or in the cover plate 12.

Each spacer elements 20 has one hinge pin 39 extending through its bore 24 and, as shown in FIG. 5, the length of the pin 39 is greater than that of the spacer element 30 and its associated recess 36. The pins 39 can be withdrawn for release by removing the clamping rods 40.

The pivot connections effected by the pins 39 thus permit the lower plates 12 to be swung outwardly from the plate portions 14 to permit access to the chain runs 15, 16 as shown at the central part of FIG. 1. The normal closed position of the plates 12 is shown at the outer end parts of FIG. 1 where the plates 12 form a continuous guide surface with the inclined faces 34 of the spacer elements 20 which close off the recesses 36 in the cover plates 12. The curved exterior surfaces 35 of the spacer elements 20 generally align and conform with the curved regions 12'' of the plates 12 and form an additional guide surface for the arm or arms of the plough body engaging into the slots 17. As shown in FIG. 1, the heads of the fixing bolts or screws 30 lie in a protected position in the recesses 39 of the spacer elements 20 but are easily accessible.

Figure 6:
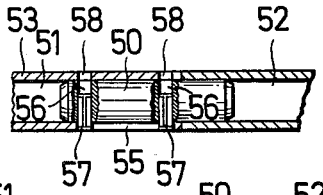
FIG. 6 is a sectional elevation of a part of the upper region of the guide assembly showing one of the locking devices.

The normal closed position of the cover plates 12 is shown in full outline in FIG. 4 and the chain dotted outline shows one of the cover plates 12 in its partly pivoted out position. It is desirable to provide detachable locking means for securing the cover plates 12 in their normal closed positions. In the structure depicted in FIGS. 1 to 5, the detachable locking means takes the form of locking devices 50 of rod-like form received in corresponding upper shaped regions of the plates 12 and plate portions 14. Thus, as shown in FIGS. 1, 4 and 5 each cover plate 12 has a curved or rolled upper edge tubular portion 53 and the associated plate portion 14 has similarly curved or rolled spaced-apart upper edge tubular portions 54 at its ends. The portions 54 align with the portions 53 of the adjacent cover plates 12 when the latter are in their normal upright closed position to thereby provide receptors 51, 52 for the locking devices 50. As shown in FIG. 6 an elongate slot 55 is provided in each end of the portion 53 of the cover plate 12. The slots 55 permit the introduction of clamping pins 57 in bores 56 of the devices 50. To release the plate 12 for pivoting outwardly it is sufficient to drive the pins 57 further into the bores 56 to release them from the slots 55. The devices 50 can now be displaced inwardly of the plate 12 to release from the receptors 52 provided by the portions 54 of the plate portion 14. To permit access to the pins 57 to enable the locking of the plate 12 to be re-established the portion 53 has openings 58 enabling a suitable tool, such as a punch, to be inserted to re-locate the pins 57 in the slots 55.

Figure 7:
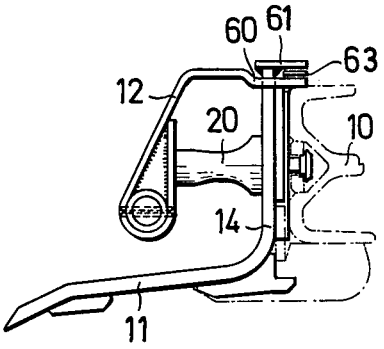
FIG. 7 is an end view of a modified guide assembly, the view generally corresponding to FIG. 4.
Figure 8:
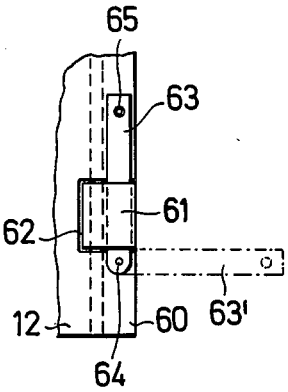
FIG. 8 is a plan view of part of the assembly shown in FIG. 7.

FIGS. 7 and 8 depict a modified guide assembly which apart from the following features is otherwise the same as that described and illustrated in FIGS. 1 to 6. The cover plate 12 in the assembly of FIGS. 7 and 8 has a flattened region at its upper part which is substantially parallel to the spacer elements 20 when the plate 12 is in its upright closed position (FIG. 7). This flattened region has a terminal edge part 60 recessed at 62 to engage locking plates 61 welded onto the upper edge of the plate portion 14 to extend perpendicular thereto. The plates 61 can be arranged at the ends of the plate portion 14 in the same manner as the portions 54 of the first embodiment. A locking bar 63 is pivotably attached to the edge part 60 of the plate 12 adjacent each recess 62. The bars 63 can pivot about pivot pins 64 between locking and release positions. In the locking position each bar 63 engages between the associated plate 61 and the cover plate edge part 60 therebeneath and a detachable fixing member 65, such as a pin or a threaded element is inserted through a bore in the plate 61 to engage in the bar 63. When the members 65 are removed however the bars 63 can be swivelled through about 90° to adopt the release positions shown in the chain-dotted outline 63' in FIG. 8. The cover plate 12 can then be swung outwards about the hinge pins 39 and here the bars 63 can act as handles.

Figure 9:
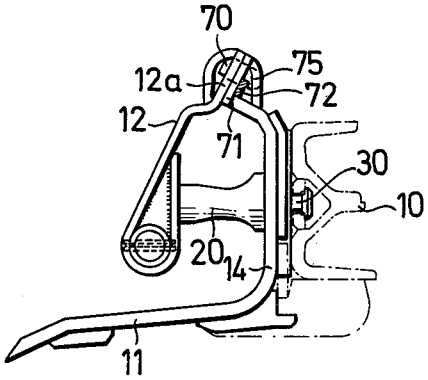
FIG. 9 is an end view of a further form of guide assembly made in accordance with the invention, the view generally corresponding to FIGS. 4 and 7.
Figure 10:
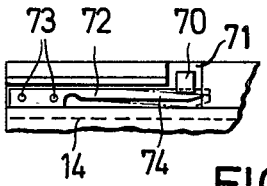
FIG. 10 is a plan view of part of the assembly shown in FIG. 9.

FIGS. 9 and 10 depict another modified assembly which is again the same as that described as illustrated in FIGS. 1 to 5 except for the following modifications pertaining to the locking means for the cover plates 12. In the structure of FIGS. 9 and 10, the cover plate 12 has an inclined upper region **12*a* carrying fixed locking members 70 of square cross-section. The plate portion 14 is here bent outwardly at its upper region and carries supports 71 against which the region 12*a* of the cover plate 12 engages. The supports 71 may again be located at the ends of the plate portion 14 in the same manner as the portions 54 of the first embodiment. The supports 71 are provided with apertures shaped for receiving the locking members 70. At the rear side of each support 71 there is provided a spring 72 affixed to the support 71 as at 73. The members 70 are recessed at 75 to receive the springs 72 automatically when the cover plate 12 is raised to its normal upright closed position. Release of the plate 12 for pivoting is accomplished by using a tool to deform the springs 72 and release the members 70. The cover plate 12 or the plate portion 14 may have one or more U-shaped protective rails as also shown in FIG. 9**.

We claim:

1. In a guide for a mineral mining machine, said guide having means defining upper and lower chain guide passages along which a drive chain for the machine is circulated, cover plates covering the guide passages, and means pivotably mounting the cover plates to permit them to be swung outwards for access to the guide passages, the improvement therein comprising: the defining means including a plurality of separate spacers vertically separating the guide passages, the pivot mounting means taking the form of hinge connections pivoting the cover plates to said spacers, and the cover plates having recesses for accepting said spacers, the cover plates and said spacers combining to form a continuous ramp-like guide surface.

2. A guide assembly for attachment to a side wall of a conveyor to form part of a machine guide, said guide assembly comprising: an angle plate having an upstanding first portion for securing to the side wall, and having a second foot portion inclined thereto to form a support for the machine, a ramp-like cover plate mounted in relation to said first portion to combine therewith and define at least part of upper and lower chain guide channels, spacing elements spaced-apart longitudinally of the assembly and separating the upper and lower chain guide channels, pivot connections established between said spacing elements and said cover plate to permit the latter to move between an upright position closing off the chain guide channels and a swung-out position permitting access to the chain guide channels, and said cover plate having recesses therein shaped to receive said spacing elements.

3. A guide for a mineral mining machine, said guide comprising: cover plates covering upper and lower chain-drive guide passages formed alongside a mineral face; spacing elements separating the chain guide passages; pivot joints provided between the spacing elements and the cover plates for enabling the cover plates to be pivoted outwards to permit access to the guide passages; the cover plates having recesses into which the spacing elements are positioned when the cover plates are in their normal closed position covering the chain guide passages; and means for locking the cover plates in their normal closed position covering the chain guide passages.

4. A guide according to claim 3, wherein the recesses and the spacing elements have a generally rectangular profile as viewed from the mineral face.

5. A guide according to claim 3, wherein the cover plates have ramp-like inclined portions which combine with correspondingly shaped surfaces of the spacing elements in forming a continuous guide surface.

6. A guide according to claim 3, wherein each spacing element has a main web portion separating the chain guide passages and a further hollow portion for receiving a hinge pin forming part of one of said pivot joints.

7. A guide according to claim 6, wherein the web portion of each spacing element has a trough-shaped upper and lower surface.

8. A guide according to claim 6, wherein the web portion of each spacing element has bores extending through the web portion for receiving fixing means for securing the spacing element to a conveyor.

9. A guide according to claim 6, wherein the spacing elements are of one-piece integral construction.

10. A guide according to claim 3, and further comprising angle plates with upstanding portions for securing to a conveyor side wall and foot portions extending beneath the cover plates to provide support for the machine.

11. A guide according to claim 3, wherein the lower region of each cover plate is curved to provide apertures for receiving hinge pins of said pivot joints.

12. A guide according to claim 11, wherein web plate attachments are welded between a rear flange continuation of said curved lower region and an inner face of each cover plate and the web plate attachments have holes receiving said hinge pins.

13. A guide according to claim 3 and constructed from assemblies each of which comprises one of said cover plates and two of said spacing elements spaced apart along the guide.

14. A guide according to claim 3 and further comprising angle plates with upstanding portions for securing to a conveyor side wall and foot portions extending beneath the cover plates to provide support for the machine.

15. A guide according to claim 14, wherein the locking means comprises rod-like locking devices slidable in receptors provided at upper regions of the cover plates and angle plates.

16. A guide according to claim 15, wherein the receptors for the locking devices are formed by curved upper portions of the cover plates and angle plates providing apertures receiving the devices and wherein at least one of said curved portions associated with each device is provided with a slot engageable with at least one locking element which serves to prevent or allow slidable movement of the associated device to thereby lock or release the associated cover plate.

17. A guide according to claim 3, wherein the locking means comprises pivotable bars carried by the cover plates and lockable with respect to the angle plates.

18. A guide according to claim 3, wherein the locking means comprises locking members carried by the cover plates and co-operating with springs supported by the angle plates.

* * * * *